US007717178B2

(12) United States Patent
Gaudette et al.

(10) Patent No.: US 7,717,178 B2
(45) Date of Patent: May 18, 2010

(54) SCREEN COUPLER FOR MODULAR SCREEN PACKS

(75) Inventors: Sean L. Gaudette, Katy, TX (US); Bennett M. Richard, Kingwood, TX (US); Jason J. Barnard, Katy, TX (US); Kevin C. Holmes, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 328 days.

(21) Appl. No.: 12/006,481

(22) Filed: Jan. 3, 2008

(65) Prior Publication Data

US 2009/0173498 A1 Jul. 9, 2009

(51) Int. Cl.
*E21B 43/04* (2006.01)
*E03B 3/18* (2006.01)
*B23P 15/16* (2006.01)

(52) U.S. Cl. ..... 166/278; 166/51; 166/227; 166/285; 29/896.61

(58) Field of Classification Search ..... 166/227, 166/205, 278, 51, 56, 157; 29/896.61
See application file for complete search history.

(56) References Cited

U.S. PATENT DOCUMENTS 3,997,006 A 12/1976 Wetzel
4,510,996 A * 4/1985 Hardin ..... 166/227
4,522,264 A * 6/1985 McNeer ..... 166/278
4,662,453 A 5/1987 Brisco
4,700,777 A 10/1987 Luers
5,343,949 A 9/1994 Ross et al.
6,899,176 B2 * 5/2005 Hailey et al. ..... 166/278

OTHER PUBLICATIONS

Henry Restarick, Horizontal Completion Options in Reservoirs With Sand Problems, Mar. 11, 1995, pp. 545-560, SPE 29831, Society of Petroleum Engineers, Inc., U.S.A.
Karen Bybee, Horizontal-Openhole Gravel-Packing Operations in the Campos Basin, Journal of Petroleum Technology, Jul. 2007, pp. 57-58, vol. 59, No. 7, Society of Petroleum Engineers, U.S.A.
Giin-Fa Fuh, et al., Reservoir formation failure and sanding prediction for well-construction and completion design, World Oil, Aug. 2007, pp. 107-114, vol. 228, No. 8, Gulf Publishing Company, U.S.A.

(Continued)

*Primary Examiner*—David J Bagnell
*Assistant Examiner*—Yong-Suk Ro
(74) *Attorney, Agent, or Firm*—Greenberg Traurig LLP; Anthony F. Matheny

(57) ABSTRACT

A coupler for gravel packing completions comprising an annular member having an upper end, a lower end, at least one flange disposed along an inner wall surface of the annular member intermediate the upper and lower ends, and at least one deformable portion is disclosed. The coupler may be used to connect one or more screens to a base pipe in a gravel packing completion by deforming the deformable portion such as by passing a swage over the outer wall surface of the annular member. In a similar manner, the coupler may also be used to connect a gravel packing completion component, such as an inflow control device to the base pipe of the gravel packing completion, to contemporaneously connect a screen section and a gravel packing completion component to the base pipe.

7 Claims, 5 Drawing Sheets

OTHER PUBLICATIONS

Andy Jordan, et al., Keeping fines in their place to maximize inflow performance, World Oil, Aug. 2007, pp. 115-122, vol. 228, No. 8, Gulf Publishing Company, U.S.A.

Karen Bybee, Inflow-Control Devices, Journal of Petroleum Technology, Mar. 2008, pp. 81-83, vol. 60, No. 3, Society of Petroleum Engineers, U.S.A.

Notification of Transmittal of the International Search Report and the Written Opinion of the International Searching Authority, Or the Declaration, Jul. 16, 2009, pp. 1-4, PCT/US2008/086154, Korean Intellectual Property Office.

International Search Report, Jul. 16, 2009, pp. 1-3, PCT/US2008/086154, Korean Intellectual Property Office.

Written Opinion of the International Searching Authority, Jul. 16, 2009, pp. 1-6, PCT/US2008/086154, Korean Intellectual Property Office.

E. Paul Bercegeay, A One-Trip Gravel Packing System, Feb. 7, 1974, pp. 1-12, SPE 4771, American Institute of Mining, Metallurgical, and Petroleum Engineers, Inc., U.S.A.

E. Harold Vickery, Application of One-Trip Multi-Zone Gravel Pack to Maximize Completion Efficiency, Oct. 12, 2000, pp. 1-10, SPE 64469, Society of Petroleum Engineers Inc., U.S.A.

Stephen P. Mathis, Sand Management: A Review of Approaches and Concerns, May 13, 2003, pp. 1-7, SPE 82240, Society of Petroleum Engineers Inc., U.S.A.

* cited by examiner

SCREEN COUPLER FOR MODULAR SCREEN PACKS

BACKGROUND

1. Field of Invention

The invention is directed to gravel pack completions in oil and gas wells and, in particular, to retainer members or couplers for connecting a screen of the gravel pack completion to a base pipe of the gravel pack completion.

2. Description of Art

In completing wells having production or injection zones which lie adjacent to incompetent formations formed from unconsolidated matrixes such as loose sandstone, or which lie adjacent formations that have been hydraulically-fractured and propped such as through fracturing processes, sand control problems often arise during the operational life of the well. These sand control problems are encountered when large volumes of sand and/or other particulate material such as backflow of proppants from a hydraulically-fractured formation dislodge from the formation and become entrained in the formation fluids and are produced therewith into the wellbore. These produced materials have an adverse effect on the operation of the well because they can cause erosion and plugging of the well equipment which, in turn, leads to high maintenance costs and considerable downtime of the well.

One technique for controlling sand production in a wellbore is referred to as "gravel packing" or forming a "gravel pack completion." In general, a gravel pack completion comprises a screen, such as a fluid-permeable liner, a perforated liner, a slotted liner, a pre-packed screen, that is disposed within an open-hole or cased wellbore adjacent the incompetent or fractured zone and is surrounded by aggregate or particulate material collectively referred to as "gravel." The screen is disposed over a base pipe that may or may not be perforated. As known in the art, the gravel particles are sized to block or filter out the formation particulates that may become entrained in the produced fluids, while the openings in the screen are sized to block the gravel from flowing into the screen. In many instances, the gravel pack completion comprises one screen section or joint connected disposed adjacent screen joint or to another component, such as a inflow control device, along the length of the base pipe.

SUMMARY OF INVENTION

Broadly, retainer members or couplers for connecting a screen of the gravel pack completion to a base pipe of the gravel packing completion comprise an annular member having an outer wall surface and an inner wall surface, the inner wall surface comprising a flange having at least one gripping surface projecting inwardly from the inner wall surface. The annular member comprises at least one deformable portion that can be deformed to make the connection between the coupler and the screen section or other component, e.g., an inflow control device and the base pipe.

The coupler can be placed over one end of a lower screen section and over one end of an upper screen section, or over an end of another component of the gravel packing completion, or simply placed in contact with the base pipe. After assembly of the coupler to the screen section(s) or other component, a swage device is then moved over the outer wall surface of the annular member causing the deformable portions of the annular member to deform. In so doing, the now deformed portions of the annular member secures the coupler to the two screen section ends and the base pipe, the one screen section end and the end of the other component of the gravel packing completion to the base pipe, or one screen end to the base pipe.

Although the terms "upper" and "lower," as well as "above" and "below," may be used herein to describe the orientation of one component relative to another component, and the Figures show the orientation of the various structures shown therein in an "upper" and "lower" orientation, it is to be understood that the gravel pack completion may be oriented horizontally. Thus, the terms "upper," "lower," "above," and "below" as used herein are to be understood as not limiting the gravel pack completions disclosed herein to a vertical orientations.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
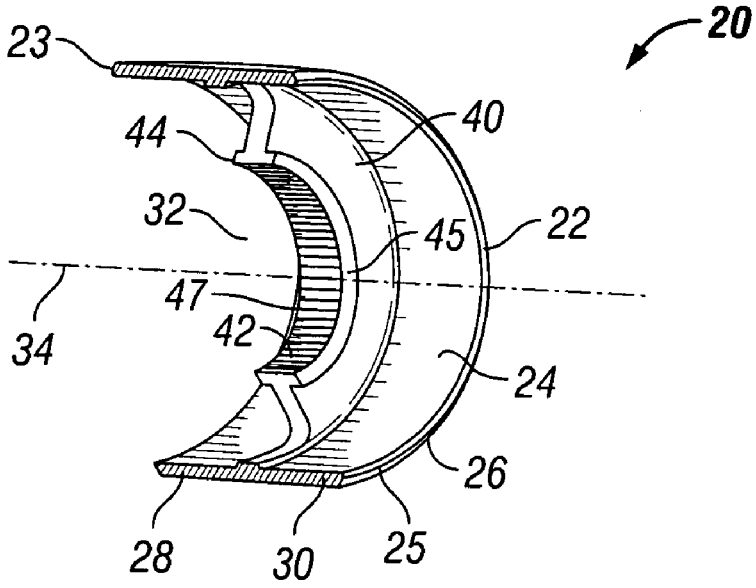
FIG. 1 is a partial perspective view of one specific embodiment of the retainer member or coupler disclosed herein.

Referring now to FIG. 1, retainer member or coupler 20 comprises annular member 22 having upper end 23, lower end 25, inner wall surface 24, outer wall surface 26, deformable portions 28, 30, bore 32 and axis 34. Flange 40 is disposed intermediate between upper end 23 and lower end 25 along inner wall surface 24 and, thus, extends inwardly toward axis 34 of annular member 22. As shown in FIG. 1, flange 40 is disposed equidistant between upper end 23 and lower end 25 along inner wall surface 24. However, it is to be understood that flange 40 may be disposed any where between upper end 23 and lower end 25 as desired or necessary to facilitate connection of the gravel pack completion component to the base pipe (not shown in FIG. 1 but discussed in greater detail below) of the gravel pack completion.

Flange 40 includes inner end 42 that defines an inner diameter of annular member 22. In the embodiment of FIG. 1, inner end 42 comprises gripping member 44. As shown in FIG. 1, gripping member 44 is an inner diameter flange 45 or "foot" attached to or formed integral with flange 40 to form bore 32. Inner diameter flange 45 has an arc-shape that is concentric with annular member 22 and can be reciprocal in shape to the outer wall surface of a tubular member, such as a base pipe (not shown in FIG. 1 but discussed in greater detail below) disposed through bore 32 of coupler 20. Gripping member 44 facilitates gripping the base pipe when disposed through bore 32. Wickers 47, threads (not shown) or other gripping elements may be disposed along gripping member 44 to increase the grip of gripping member 44 to the base pipe.

In the embodiment shown in FIG. 1, flange 40 is a single piece so that gripping member 44 forms a circle. In another embodiment illustrated in FIG. 2, flange 40 is segmented to provide a plurality of flange portions 50, 52, and 54 (shown in FIGS. 3-4) disposed radially along inner wall surface 24. Each flange portion 50, 52 is set apart from the next flange portion by slot 55. Flange portions 50, 52, 54 include gripping member 56, 58, 60 respectively, which taken together form bore 32. The "spoked" center of annular member 22 facilitates transferring forces from the swage (not shown) used to force deformation portions 28, 30 inward as discussed in greater detail below, through inner wall surface 24 of annular member 22, and into gripping members 56, 58, 60 for gripping the base pipe (not shown in FIG. 2, but discussed in greater detail below). The "spoked" center of annular member 22 also allows annular flow through coupler 20 in embodiments where the base pipe is not perforated.

As discussed above, annular member 22 includes deformable portions 28, 30 to facilitate securing one or more screen sections or a screen section and an adjacent gravel packing completion component such as an inflow control device to a base pipe of the gravel packing completion. Although, deformable portions 28, 30 are identified in the Figures as being discrete portions of annular member 22, it is to be understood that annular member 22, as a whole, may be deformable. In other words, annular member 22 may be formed out of a material that is deformable. Moreover, coupler 20, as a whole, may be formed out of a deformable material. Alternatively, one or more portions or structures of coupler 20 may be formed out of a non-deformable material, while deformable portions 28, 30 may be formed out of deformable material. Further, one or more portions or structures of coupler 20 may be formed out of one deformable material, while deformable portions 28, 30 may be formed out of another deformable material. In one particular embodiment, coupler 20 is formed completely out of a metal such as steel.

Figure 3:
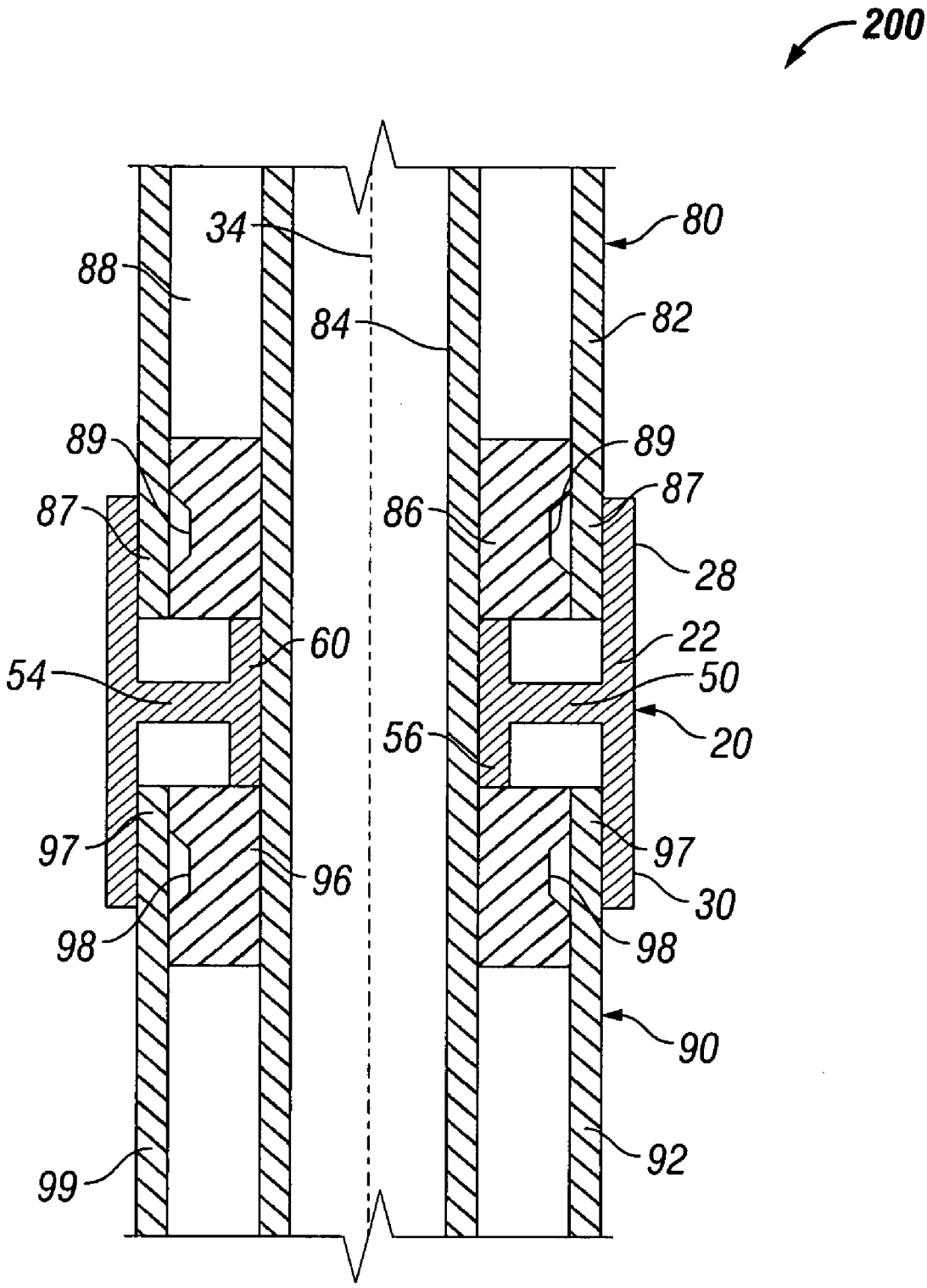
FIG. 3 is a cross-sectional view of the coupler of FIG. 2 shown disposed between two ends of adjacent screen sections and around a base pipe prior to being swaged.
Figure 4:
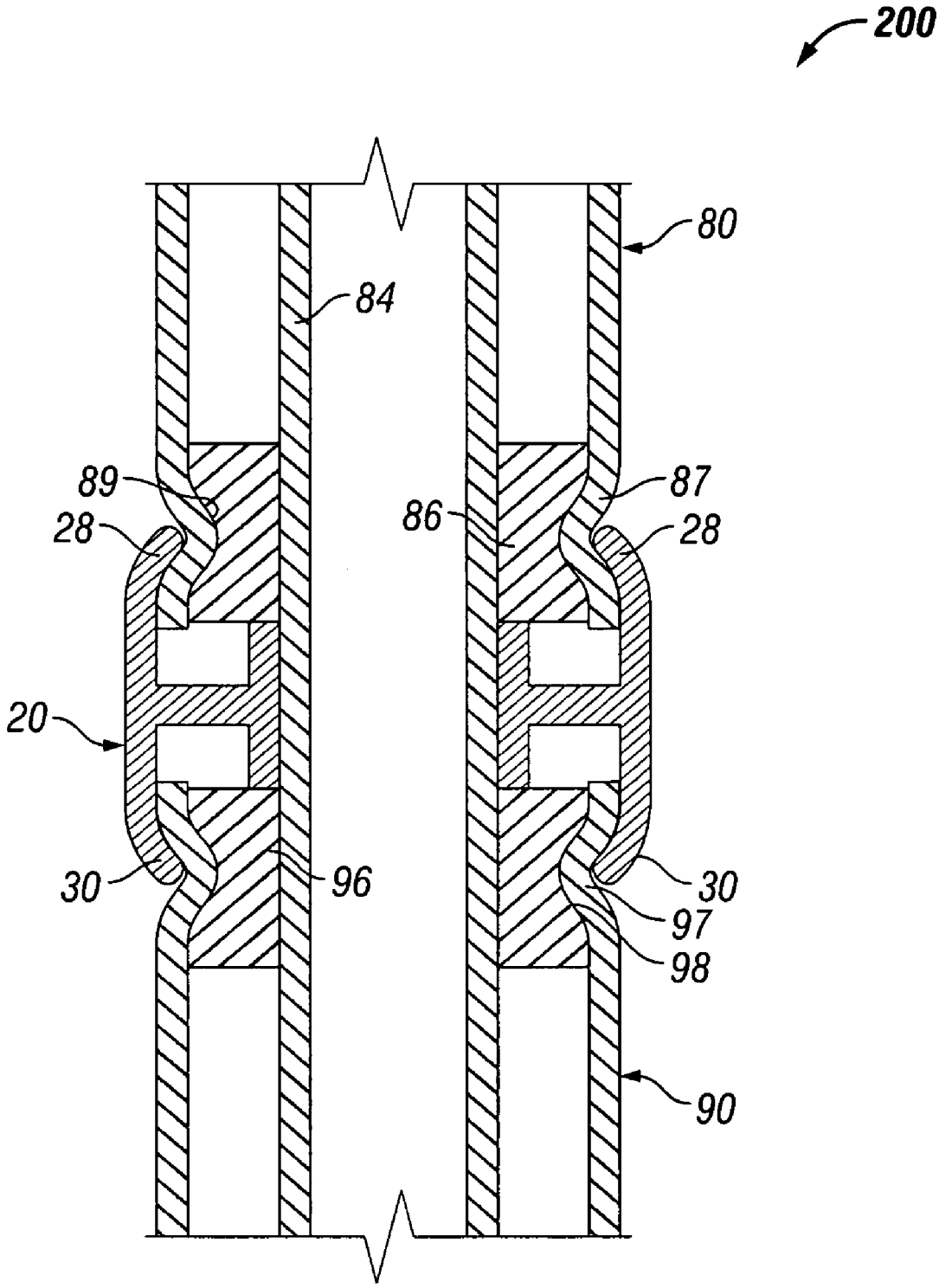
FIG. 4 is a cross-sectional view of the coupler of FIG. 2 shown disposed between two ends of adjacent screen sections and around a base pipe after being swaged so that the two screen sections are secured together.

Referring now to FIGS. 3-4, gravel packing completion 200 comprises upper screen section 80 comprises outer shroud 82, base pipe 84, and cartridge end cap 86. Porous material (not shown), woven screen (not shown), or wrapped wire (not shown) may be disposed within annulus 88 between outer shroud 82 and base pipe 84. Cartridge end cap 86 includes recess 89 along its outer wall surface.

In the embodiment of FIGS. 3-4, gravel packing completion 200 also comprises lower screen section 90 comprises outer shroud 92, base pipe 84, and cartridge end cap 96 having recess 98 along the outer wall surface of cartridge end cap 96. Porous material (not shown), woven screen (not shown), or wrapped wire (not shown) may be disposed within annulus 99 between outer shroud 82 and base pipe 84.

Cartridge end caps 86, 96 may be secured to base pipe 84 through any method or device known to persons of ordinary skill in the art.

Once assembled as shown in FIG. 3, a swage (not shown) is passed over outer wall surface 28 of annular member 22 from upper end 23 to lower end 25 or vice versa. As swage is moved along outer wall surface 28 of annular member 22, deformable portions 28, 30 are forced inward toward axis 34. Deformable portions 28, 30, thus, force deformable portions 87, 97 of upper and lower screen sections 80, 90, respectively, into recesses 89, 98, respectively (FIG. 4). After the swage is passed over outer wall surface 28, coupler 20 is secured to upper and lower screen sections 80, 90 and to base pipe 84. In certain embodiments, the deformation of deformable portions 28, 30 and deformable portions 87, 97 of upper and lower screen sections 80, 90 respectively, into recess 89, 98, respectively, provide a metal to metal seal.

Figure 2:
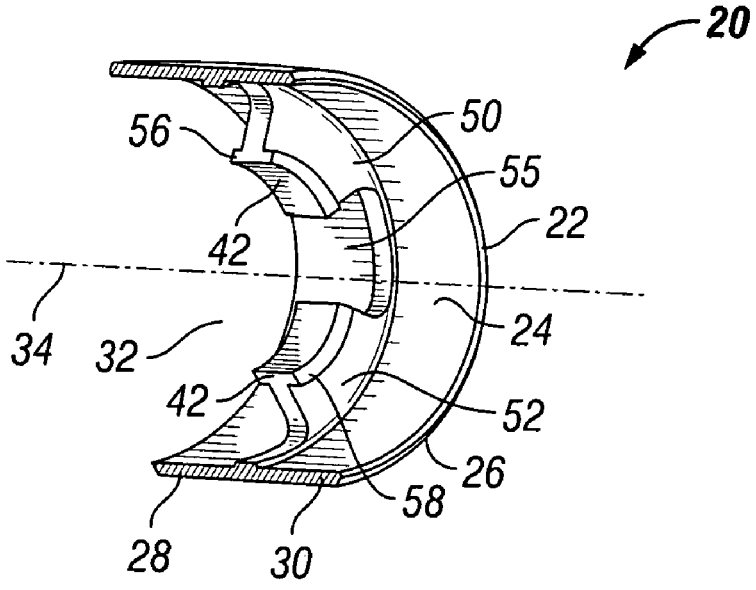
FIG. 2 is a partial perspective view of another specific embodiment of the retainer member or coupler disclosed herein.
Figure 5:
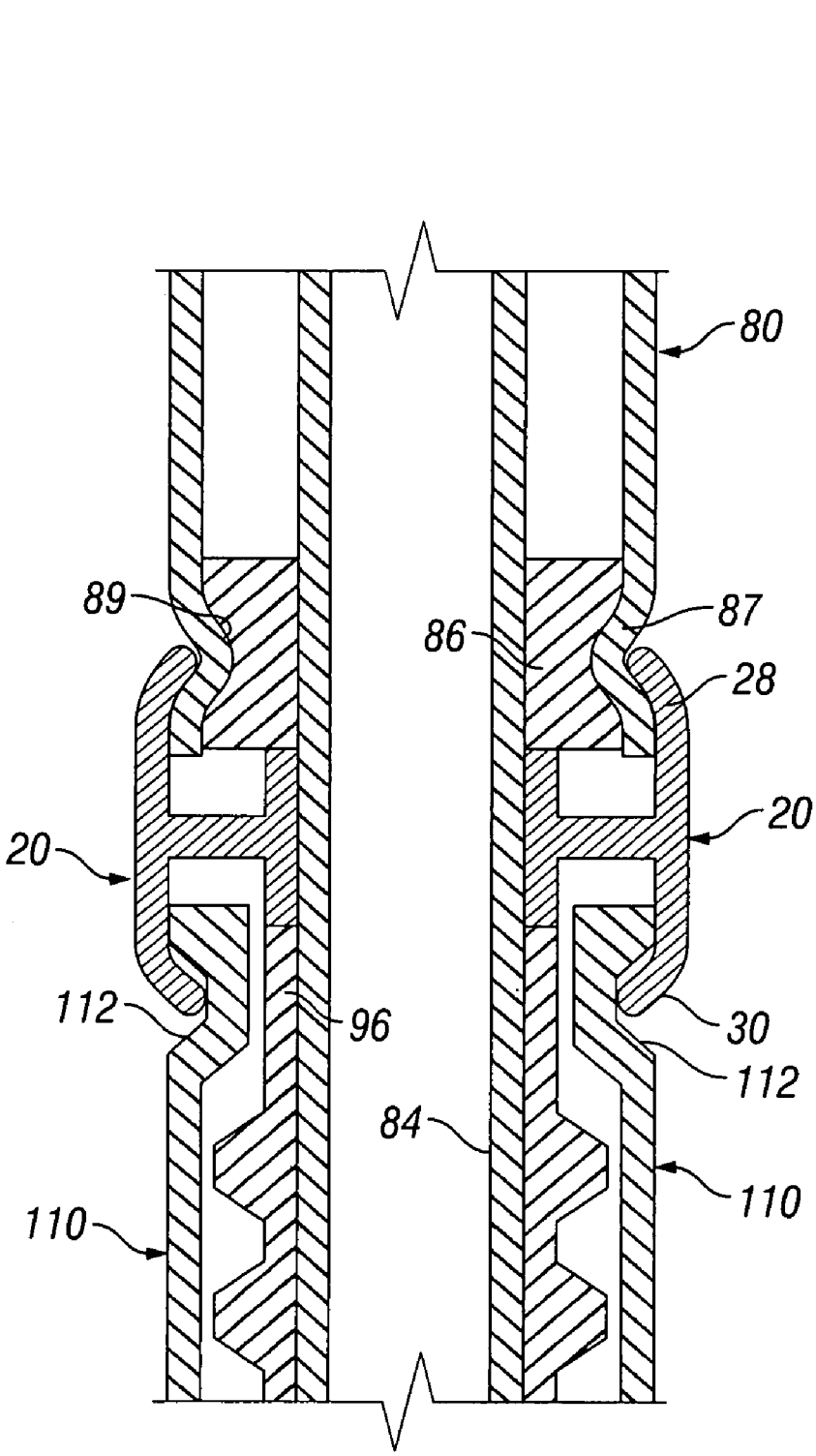
FIG. 5 is a cross-sectional view of the coupler of FIG. 2 shown disposed between one end of a screen section and an adjacent inflow control device and around a base pipe after being swaged so that the screen section and the inflow control device are secured together.
Figure 7:
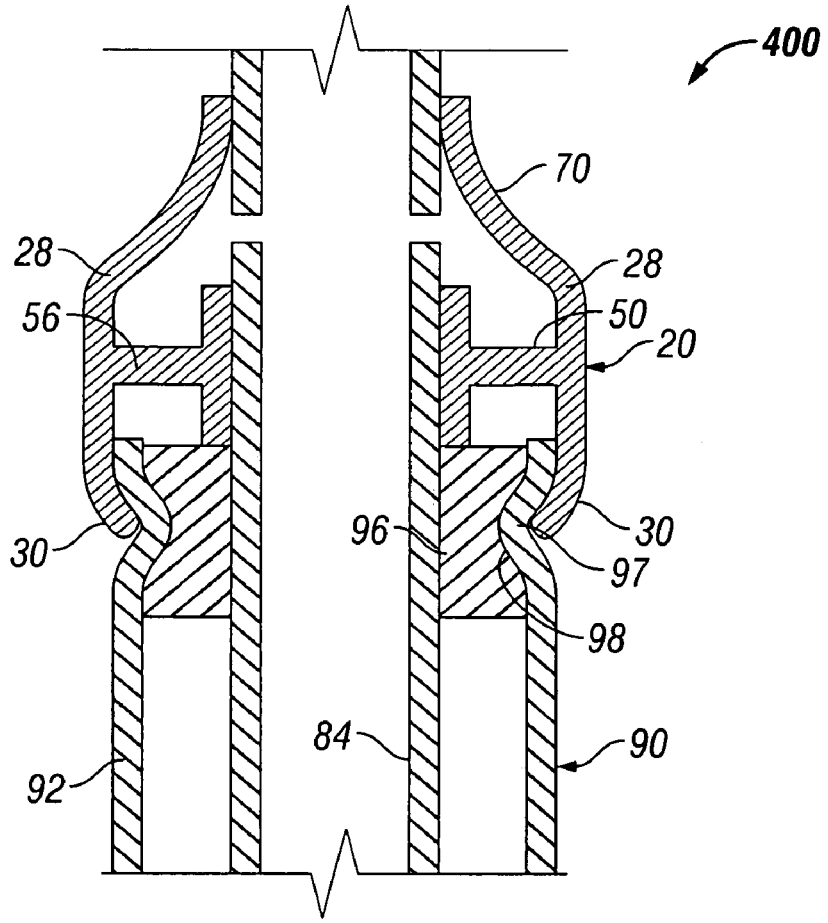
FIG. 7 is a cross-sectional view of the coupler of FIG. 6 shown disposed against an outer wall surface of a base pipe as an end termination of one end of a screen section so that the end of the screen section is secured to the base pipe.

Referring now to FIG. 5, in another embodiment, gravel packing completion 300 comprises base pipe 84 and coupler 20 disposed along one end of screen section 80 having the same structures as discussed above with respect to upper screen section 80 of FIGS. 2-4, and one end of adjacent gravel packing completion component 110. Gravel packing completion component 110 is shown in FIG. 7 as an inflow control device, however, it is to be understood that gravel packing completion 10 may be any other component of gravel packing completion 300 desired or necessary as part of the gravel pack completion. Gravel packing completion component 110 includes recess 112 for receiving deformable portion 30 in the same manner as discussed above, e.g., by sliding a swage over outer wall surface 28 of annular member 22. Contemporaneously with the swage deforming deformable portion 30 into recess 112 of gravel packing completion component 110, the swage deforms deformable portion 28 of coupler 20 and deformable portion 87 of upper screen section 80 into recess 89 of cartridge end cap 86. Accordingly, upper screen section 80 and gravel packing completion component 100 are secured to base pipe 84.

Figure 6:
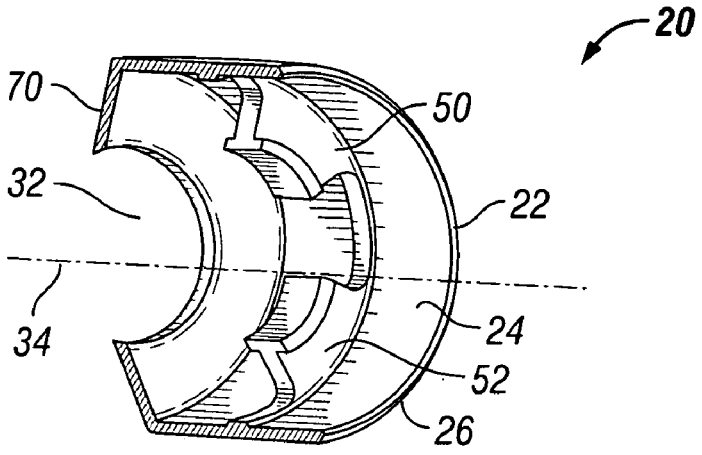
FIG. 6 is a partial perspective view of another specific embodiment of the retainer member or coupler disclosed herein.

In another embodiment, shown in FIGS. 6-7, coupler 20 comprises annular member 22 having end flange 70 together with the other structures discussed above with respect to FIG. 2. End flange 70 may be used to secure coupler 20 to another component (not shown) in the gravel packing completion. Thus, end flange 70 may comprises threads (not shown) or other attachment devices as desired or necessary to secure end flange 70 to the other tool string component.

Alternatively, as illustrated in FIG. 7, end flange 70 may function as an end termination to secure an upper end of a screen section, shown as screen section 90, to base pipe 84 (shown in FIG. 7 as being perforated), in gravel packing completion 400, where no other component is disposed adjacent an end of the screen section. To secure end flange 70 to base pipe 84, the swage is passed over outer wall surface 26 of annular member 22 in the same manner as discussed above with respect to FIGS. 3-4. In so doing, deformable portion 30 is deformed to secure the upper end of screen section 90 in the same manner as discussed above with respect to FIGS. 3-4 and deformable portion 28 is deformed forcing end flange 70 into the outer wall surface of base pipe 84, causing end flange 70 to connected to base pipe 84.

It is to be understood that the invention is not limited to the exact details of construction, operation, exact materials, or embodiments shown and described, as modifications and equivalents will be apparent to one skilled in the art. For example, although flange 40 (and flange portions 50, 52, 54) are shown being disposed equidistance from the upper and lower ends of annular member 22, flange 40 (and flange portions 50, 52, 54) may be disposed "off-center," i.e., close to the upper or lower end, as desired or necessary to facilitate securing coupler 20 to a screen section or tool string component. Accordingly, the invention is therefore to be limited only by the scope of the appended claims.

What is claimed is:

1. A gravel pack completion comprising:

a first screen section having a first screen section end, a first screen section bore, and a first screen section inner wall surface;

a base pipe disposed through the first screen section bore, the base pipe having a base pipe outer wall surface;

a first cartridge end cap disposed along the base pipe outer wall surface and the first screen section inner wall surface, the first cartridge end cap comprising a first recess disposed in a first cartridge end cap outer wall surface; and a coupler disposed over the first screen section end, the coupler comprising an annular member having at least one flange disposed along an inner wall surface of the annular member, the at least one flange contacting the outer wall surface of the base pipe, and a first deformable portion disposed over the first recess so that deformation of the first deformable portion forces a first screen section portion into the first recess.

2. The gravel pack completion of claim 1, wherein the coupler further comprises a first coupler end and a second coupler end, the first deformable portion being disposed proximate to the first coupler end and the second coupler end comprising an end flange having a second deformable portion.

3. The gravel pack completion of claim 1, further comprising a gravel pack completion component disposed adjacent the first screen section, the gravel pack completion component comprising a component recess, wherein the coupler is disposed over the gravel pack completion component and a second deformable portion of the coupler is disposed over the component recess so that deformation of the second deformable portion forces a portion of the annular member into the component recess.

4. The gravel pack completion of claim 3, wherein the gravel pack completion component is an inflow control device.

5. The gravel pack completion of claim 1, further comprising a second screen section comprising a second screen section end, a second screen section bore, and a second screen section inner wall surface, the second screen section being disposed adjacent the first screen section and the base pipe being disposed through the second screen section bore; and a second cartridge end cap disposed along the base pipe outer wall surface and the second screen section inner wall surface, the second cartridge end cap comprising a second recess disposed in a second cartridge end cap outer wall surface, wherein the coupler is disposed over the second screen section end and a second deformable portion of the coupler is disposed over the second recess so that deformation of the second deformable portion forces a second screen section portion into the second recess.

6. The gravel packing completion of claim 1, wherein the flange of the coupler is segmented having a plurality of flange portions separated from each other by a slot.

7. The gravel packing completion of claim 1, wherein the flange comprises a gripping member, the gripping member comprising an inner diameter flange having at least one wicker and an arc-shape that is concentric with the annular member.

* * * * *